United States Patent [19]

Paul et al.

[11] Patent Number: 4,793,765

[45] Date of Patent: Dec. 27, 1988

[54] MATERIAL HANDLING APPARATUS

[75] Inventors: David S. Paul, Disley; Richard S. Saunders, Sale, both of United Kingdom

[73] Assignee: Massey-Ferguson Services N.V., Netherlands Antilles

[21] Appl. No.: 91,180

[22] Filed: Aug. 31, 1987

[30] Foreign Application Priority Data

Jul. 24, 1987 [GB] United Kingdom ..... 8717654

[51] Int. Cl.[4] ..... B66C 23/00; B66F 9/00

[52] U.S. Cl. ..... 414/718; 414/697; 52/118; 212/268; 212/269

[58] Field of Search ..... 414/718, 728, 697; 403/363, 104, 109; 52/118; 212/267, 268, 269

[56] References Cited

U.S. PATENT DOCUMENTS

| | | | |
|---|---|---|---|
| 2,316,389 | 4/1943 | Atkinson | 403/104 X |
| 2,685,876 | 8/1954 | Sanderson | 403/104 X |
| 3,337,071 | 8/1967 | Clark | 414/728 |
| 4,604,026 | 8/1986 | Barrett | 414/728 |

FOREIGN PATENT DOCUMENTS

| | | | |
|---|---|---|---|
| 817363 | 10/1951 | Fed. Rep. of Germany | 403/363 |
| 1254593 | 1/1961 | France | 403/109 |

*Primary Examiner*—Robert J. Spar
*Assistant Examiner*—Jennifer L. Doyle

[57] ABSTRACT

An extendable material handling arm which is particularly suitable for use as a dipper stick of a back hoe digger. The arm has an outer member with a slot extending along its length, and an inner member provided with a digging bucket pivotally mounted adjacent one end. The inner member is encircled by the outer member for sliding therein to vary the effective length of the arm. A first support structure carried by the inner member adjacent the end remote from the bucket includes a support plate with a support surface for sliding contact with longitudinally extending portions of the outer surface of the outer member adjacent the slot. A pair of studs extend through the slot to secure the support plate to the inner member so that the end of the inner member remote from the bucket is supported within the outer member by holding portions of the outer member adjacent the slot between the plate support surface and a support surface on the inner member and clearance is left between the inner and outer members along side portions opposite and remote from the slot. A second support structure may be provided adjacent the end of the outer member nearest the bucket to provide sliding support for the inner member within the outer member, thus also avoiding direct contact between the inner and outer members. The sliding support of both support structures may be provided via low friction material such as self-lubricating cast nylon oil-impregnated material.

9 Claims, 3 Drawing Sheets

MATERIAL HANDLING APPARATUS

BACKGROUND OF THE INVENTION

This invention relates to material handling apparatus which employs an extendable arm in which an inner arm member can be slid relative to an outer encircling arm member to vary the effective length and thus the reach of the arm.

Such apparatus is well known. See, for example, U.S. Pat. No. 3,140,000 which discloses a backhoe digger with an extendable arm in the form of a dipper stick.

Although such apparatus functions adequately, it frequently presents a positional stability problem in that the inner arm is often, even when new, a relatively loose sliding fit in the outer member. Also even if the initial fit is good, a maintenance problem eventually arises since the wear between the sliding inner and outer arm members reaches a level which impedes the operation of the apparatus and this wear must be taken up by shims or wear plates which is a time consuming and often costly business.

It is an object of the present invention to provide an extendable material handling arm in which the sliding fit between the inner and outer members is relatively easily controlled, in which wear between the inner and outer slidable members is reduced and in which maintenance is also simplified.

Thus according to the present invention there is provide an extendable material handling arm comprising an outer member having a slot extending along the length thereof, an inner member provided with material handling means adjacent one end, the inner member being encircled by the outer member for sliding therein to vary the effective length of the arm, a first support structure carried by the inner member adjacent the end thereof remote from the material handling means, the first support structure including a support means having a support surface for sliding contact with longitudinally extending portions of the outer surface of the outer member adjacent the slot, and securing means extending through said slot for securing the support means to the inner member for sliding movement therewith so that said remote end of the inner member is supported within said outer member by holding said portions of the outer member adjacent the slot between said support means support surface and a support surface on the inner member and clearance is left between the inner and outer members along side portions opposite and remote from the slot.

If, for example, the outer member is of generally rectangular cross-section with the slot extending longitudinally down one side of the outer member the first support structure will pull the inner member into contact with the slotted side of the outer leaving clearance between the inner and outer members along their sides opposite the slot. This clearance will be present along substantially the entire length of the inner member within the outer member. Such an arrangement significantly simplifies manufacture since it removes the need for close control of the sliding fit between the inner and outer arm members. Also since contact between the inner and outer members is reduced wear is also reduced.

Preferably a second support structure is provided for sliding support of the inner member within the outer member at a location adjacent the end of the outer member nearest the material handling means so that direct contact between the inner and outer members is also avoided at this location.

Wear can be reduced still further by providing one or both support structures with low friction support surfaces made, for example, from self-lubricating cast nylon oil-impregnated material such as "Nylacast Oilon" sold by Nylacast Oilon Limited of Leicester, United Kingdom. If such an oil impregnated material is used, no lubrication of the sliding contact between the inner and outer members is necessary.

Preferably the first support structure supports the inner member against transverse movement within the outer member in directions at right angles to the direction of extent of the securing means. This transverse support is also preferably provided by surfaces of low friction material on the inner member for contact with the inner surface of the outer member.

The second support structure preferably comprises a collar on the outer member, the collar encircling the inner member and supporting detachable low friction wear pads which contact the outer surface of the inner member.

The areas of sliding contact between the support surface and the outer member are preferably disposed outwardly away from the slot to reduce any bending moment imposed on the outer member from the inner member via the first support structure.

The invention also provides a dipper stick for a backhoe in the form of an extendable arm as described above.

BRIEF DESCRIPTION OF THE DRAWINGS

One embodiment of the present invention, as applied to a backhoe digger, will now be described, by way of example only, with reference to the accompanying drawings in which.

DESCRIPTION OF A PREFERRED EMBODIMENT

Figure 1:
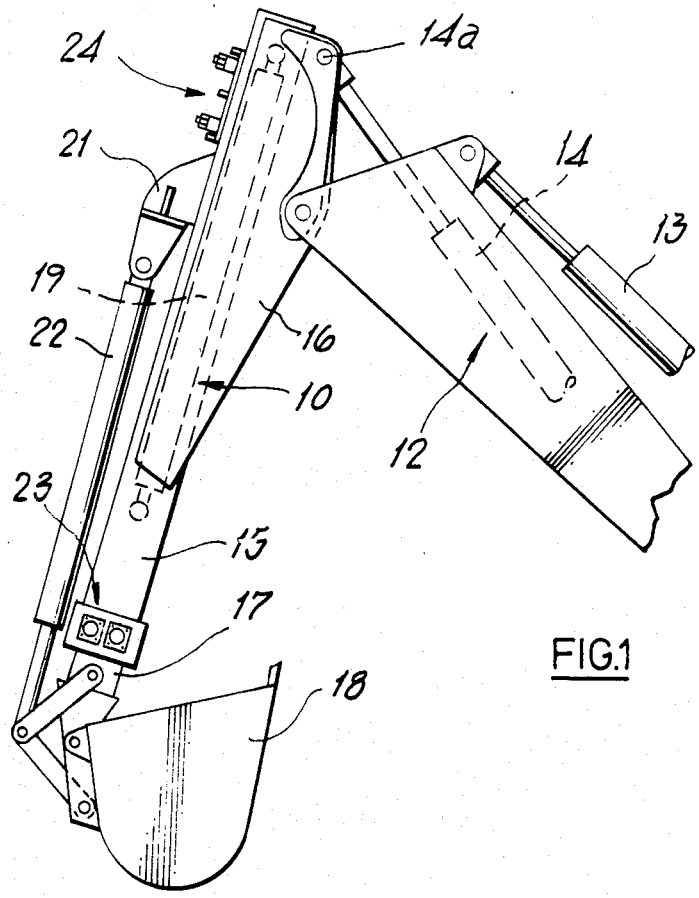
FIG. 1 is a side view of part of the digger.

FIG. 1 shows part of a backhoe digger in which an extendable dipper stick 10 is pivotted at 11 on a digger boom 12. In the conventional manner the boom 12 can be raised and lowered by an hydraulic actuator 13 and the dipper stick can be pivotted relative to the boom by an hydraulic actuator 14.

The dipper stick has a hollow square cross-section outer member 15 with reinforcing side plates 16 which provide the pivotal mounting 11 and also the mounting point 14*a* for actuator 14. A dipper stick inner member 17 is slidable in outer member 15 and carries at its lower end a bucket 18. The inner and outer dipper stick members 17 and 15 are arranged to be moved relative to each other by an hydraulic actuator 19 which acts between these members and is disposed inside the inner member 17.

Figure 3:
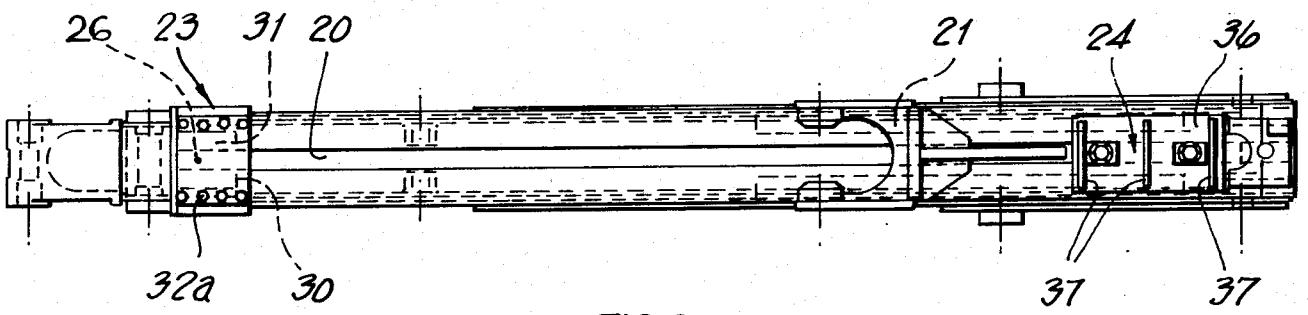
FIG. 3 is a top view of the dipper stick of FIG. 2.
Figure 2:
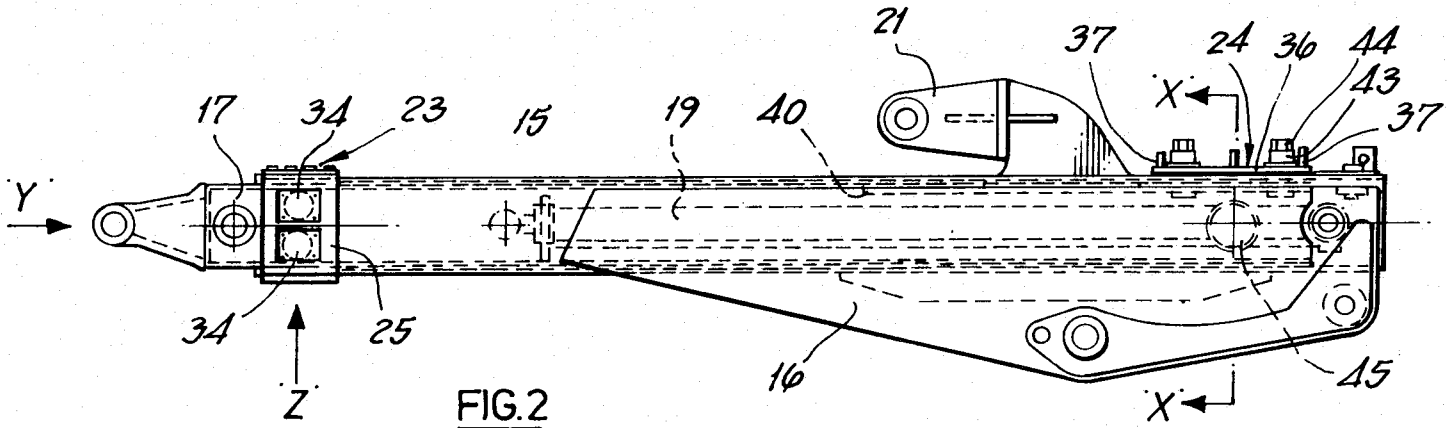
FIG. 2 is a side view of the dipper stick of FIG. 1 in more detail.

As can best be seen from FIG. 3, the upper face of the outer member 15 of the dipper stick is provided with a longitudinally extending slot 20. The inner dipper stick member 17 carries a mounting member 21 for bucket actuator 22. This mounting member extends through slot 20 and is moved along this slot as the inner and outer dipper stick members are moved relative to each other by actuator 19.

In accordance with the present invention, the inner dipper stick member 17 is supported within the outer member 15 by a first support structure 24 carried on the inner member adjacent the end remote from a bucket 18 and by a second support structure 23 which is located at the end of the outer member nearest to the bucket 18.

Figure 6:
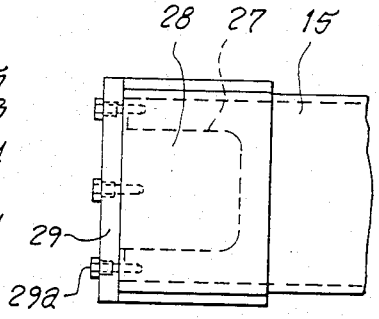
FIG. 6 is a view in the direction of arrow Z of FIG. 2.

Dealing with the second support structure 23 first, this comprises a collar 25 which is welded to the end of dipper stick outer member 15. The collar itself is of a welded construction and is provided with a slot 26 in its upper surface which acts as a continuation of slot 20 to allow the passage of outer member 21 during assembly of the dipper stick. The side 25*a* of the collar is provided with an open-fronted recess 27 (shown in dotted detail in FIG. 6) which receives a wear pad 28 of self-lubricating cast nylon oil-impregnated material (for example "Nylacast Oilon" referred to above). Wear pad 28 is retained in the recess 27 by a scraper plate 29 which is bolted at 29*a* to the end of side 25*a* of the collar. A similarly shaped open-fronted recess 30 is providing the slotted side 25*b* of the collar. This recess houses a wear pad 31 which is retained by a keeper plate 32 which overlies the side 25*b* and is retained by bolts 32*a*.

The remaining sides 25*c* and 25*d* of the dipper outer are each provided with a pair of wear pads 33, each supported in a recessed backing member 34 which is bolted to the collar by bolts 35.

The wear pads 28 and 33 are adjusted by the use of appropriate shims to ensure that minimal clearance is present between the inner member 17 and each contacting wear pad so that the inner member 17, is closely guided and supported within the outer member 15. Typically, for example, up to a maximum of 1 mm total clearance is allowed on the fit between opposite pads 33.

The first support structure 24 comprises a support means in the form of a plate 36 which is stiffened by welded webs 37 add which carries a wear pad 38 of self-lubricating cast nylon oil-impregnated material. This wear pad contacts the longitudinally extending portions of the outer surface of side 15*b* of outer member 15 along the edges of slot 20. The plate 36 is secured to the inner member of the dipper stick by a pair of studs 39, which extend through the slot 20. These studs are secured to that portion of the inner member 17 which are reinforced by a stiffening web 40, which extends from the end of the dipper remote from the bucket 18 to a location on the bucket side of the attachment point of mounting member 21. The side 17*b* of the inner member is provided with a wear pad 41 of self-lubricating cast nylon oil-impregnated material for contact with the longitudinally extending inner surface of the side 15*b* of outer member adjacent slot 20. Each stud is provided with two spacers, a spacer 42 disposed in the slot 20 and a spacer 43 under the nut 44 of the stud. By appropriate choice of thickness of these spacers, the level of contact pressure between the wear pads 38 and 41 and their contacting surfaces on the outer member can be accurately controlled. Ideally this contact pressure is controlled to be at a very low level consistent with the accurate location and support of the inner member. Again, typically up to a maximum of 1 mm total clearance is allowed on the fit between pads 38 and 41.

Figure 4:
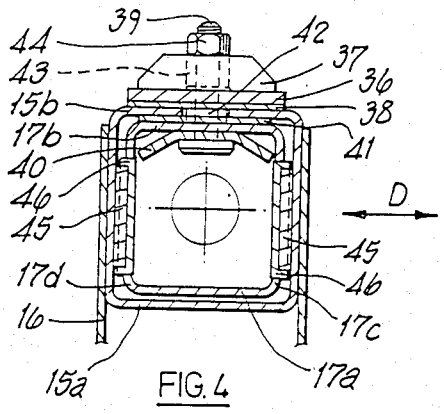
FIG. 4 is a sectional view on line x—x of FIG. 2.

As can be seen from FIG. 4, the first support structure draws the inner member into contact with the side 15*b* of the outer member, so that a clearance exists between the sides 15*a* and 17*a* of the outer and inner members respectively which are opposite and remote from the slot 20. This significantly reduces the wear since this clearance exists along the entire length of the dipper stick between the first and second support structures. Also since the dipper stick is designed to have this clearance, less accurate control of the manufacture of the inner and outer members is necessary since the fit between these two members is not used to locate accurately the inner member within the outer member during use of the dipper stick.

The first support structure also includes a pair of wear pads 45 each received in a recessed backing member 46. These backing members are welded to sides 17*c* and 17*d* respectively of the inner member. Wear pads 45 are of self-lubricating cast nylon oil-impregnated material and are not secured in the backing members 46 but are located in position during assembly by smearing the backing member recesses with grease. Tee contact pressure of pads 45 against the inner surface of the outer dipper stick member 15 is controlled by shims in the backing member recesses to be at a low level consistent with the required support and guidance of the inner member against transverse movement in directions D at right angles to the direction of constraint provided by the studs 39 and associated wear pads 38 and 41. Again typically up to a maximum of 1 mm total clearance is allowed on the fit between pads 45 and the outer member.

Figure 7:
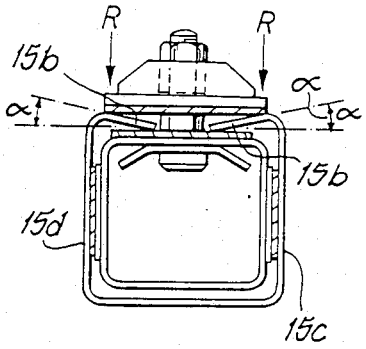
FIG. 7 is a diagrammatic representation of part of the section of FIG. 4.
Figure 5:
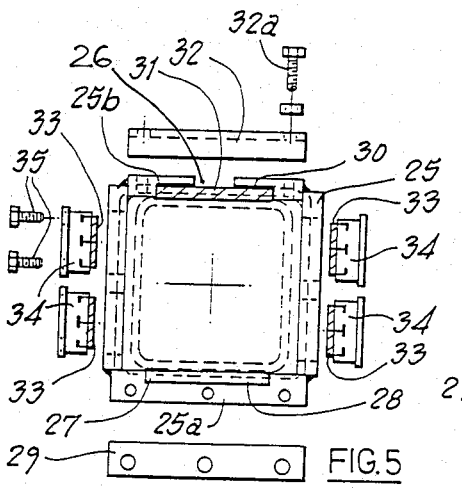
FIG. 5 is an exploded view in the direction of arrow Y of FIG. 2.

It has been found that by arranging the side portions 15*b* of the outer member which define the slot 20 to be turned slightly inwardly at an angle $\alpha$, as shown in exaggerated form in FIG. 7, the contact areas between wear pad 38 and outer member 15 are moved away from slot 20 and closer to sides 15*c* and 15*d*. Thus reaction load R (see FIG. 7) transmitted to the outer dipper member from the inner member via the first support structure is transmitted at locations closer to sides 15*c* and 15*d*. This reduces the bending moment of this reaction force and produces a more operationally satisfactory arrangement. It has been found that angles of $\alpha$ in the region of 1–2 degrees produce a significant improvement in the operation of the unit.

Figure 8:
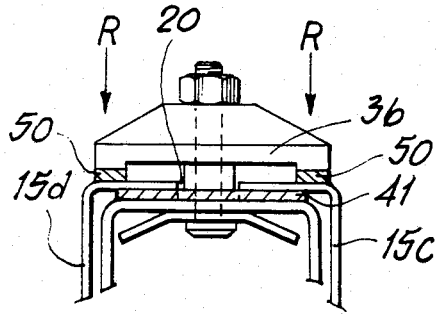
FIG. 8 is a diagrammatic representation, corresponding to FIG. 4, of part of an alternative support structure arrangement.

FIG. 8 shows diagrammatically an alternative arrangement for transmitting the reaction load R to the outer member 15 at locations well spaced from the slot 20 to reduce the bending moment of the reaction load by forming the contact area between the support plate 36 and the side portions 15*b* of the outer member as strips 50 of self-lubricating cast nylon oil-impregnated material. These strips are located on the support plate adjacent to the sides 15*c* and 15*d* of the outer member. Using this alternative arrangement, control of the angle $\alpha$ of the side portions 15*b*, as described in relation to FIG. 7, is unnecessary.

It will be evident from the above that the present invention provides an extendable arm for a material handling apparatus such as the dipper stick of a backhoe digger, in which the inner member is located in the outer member by a support structure carried on the inner member at the end thereof remote from the material handling means in a manner which minimises the contact between the inner and outer members.

As explained above, this significantly reduces wear and also simplifies manufacture since accurate control of the fit between the inner and outer members is no longer necessary along a significant length o the dipper stick.

The present invention also provides a construction in which the actual contact between the inner and outer members is provided by a number of wear pads which are of low friction material to minimise wear and which can all be replaced relatively quickly and easily, thus reducing maintenance costs.

We claim:

1. An extendable material handling arm for use in an industrial machine, the arm comprising an outer member having a slot extended along the length thereof, an inner member provided with material handling means adjacent one end, the inner member being encircled by the outer member for sliding therein, a first actuating means acting between the inner and outer members to vary the effective length of the arm and hold the arm at a selected length, a second actuating means acting between the inner member and the material handling means to move the material handling means relative to the inner member, a first support structure carried by the inner member adjacent the end thereof remote from the material handling means, the first support structure including a support means having a support surface for sliding contact with longitudinally extending portions of the outer member adjacent the slot, and securing means extending through said slot for securing the support means to the inner member for sliding movement therewith so that said remote end of the inner member is supported within said outer member by holding said portions of the outer member adjacent the slot between said support means support surface and a support surface on the inner member and clearance is left between the inner and outer members along side portions opposite and remote from the slot.

2. An arm according to claim 1 in which a second support structure is provided for sliding support of the inner member within the outer member at a location adjacent the end of the outer member nearest the material handling means so that direct contact between the inner and outer members is avoided at this location and the inner and outer members are held spaced from each other between said support structures along said side portions opposite and remote from the slot.

3. An arm according to claim 2 in which the second support structure preferably comprises a collar on the outer member, the collar encircling the inner member and supporting detachable low friction wear pads which contact the outer surface of the inner member.

4. An arm according to claim 1 in which the support means support surface and the support surface of the inner member are of self-lubricating cast nylon oil-impregnated material.

5. An arm according to claim 1 in which the first support structure supports the inner member against transverse movement within the outer member in directions at right angles to the direction of extent of the securing means.

6. An arm according to claim 5 in which the transverse support is provided by surfaces of low friction material on the inner member for contact with the inner surface of the outer member.

7. An arm according to claim 1 in which the areas of sliding contact between the support surface and the outer member are disposed outwardly away from the slot to reduce any bending moment imposed on the outer member from the inner member via the first support structure.

8. An extendable dipper stick for a backhoe comprising an outer member having a slot extended along the length thereof; an inner member provided with a digging bucket pivotally mounted adjacent one end, the inner member being encircled by the outer member for sliding therein; a first fluid pressure-operated actuator acting between the inner and outer members to vary the effective length of the dipper stick; a second fluid pressure-operated actuator acting between the inner member and the bucket to pivot the bucket for digging; a first support structure carried by the inner member adjacent the end thereof remote from the bucket, the first support structure including a support means having a support surface for sliding contact with longitudinally extending portions of the outer surface of the outer member adjacent the slot, and securing means extending through said slot for securing the support means to the inner member for sliding movement therewith so that said remote ed of the inner member is supported within said outer member by holding said portions of the outer member adjacent the slot between said support means support surface and a support surface on the inner member and clearance is left between the inner and outer members along side portions opposite and remote from the slot; and a second support structure carried on the outer chamber at a location adjacent the end thereof nearest the bucket for sliding support of the inner member within the outer member without direct contact between the inner and outer members at this location.

9. A dipper stick according to claim 8 in which the sliding support of the first and second support structures is provided by support surfaces of self-lubricating cast nylon oil-impregnated material.

* * * * *